US007092661B2

(12) United States Patent
Song

(10) Patent No.: US 7,092,661 B2
(45) Date of Patent: Aug. 15, 2006

(54) LIQUID ELECTROPHOTOGRAPHIC IMAGE FORMING APPARATUS HAVING A LIQUID CARRIER DEPOSITING UNIT

(75) Inventor: In-yong Song, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 120 days.

(21) Appl. No.: 10/849,180

(22) Filed: May 20, 2004

(65) Prior Publication Data

US 2004/0247341 A1 Dec. 9, 2004

(30) Foreign Application Priority Data

Jun. 3, 2003 (KR) ..... 10-2003-0035600

(51) Int. Cl.
*G03G 15/10* (2006.01)

(52) U.S. Cl. ..... 399/237

(58) Field of Classification Search ..... 399/222, 399/233, 237, 296, 297, 302, 308, 341, 390, 399/107, 119, 223, 239
See application file for complete search history.

(56) References Cited

U.S. PATENT DOCUMENTS

| | | | | |
|---|---|---|---|---|
| 6,016,419 | A * | 1/2000 | Hirai | 399/390 |
| 6,353,721 | B1 * | 3/2002 | Yamaguchi et al. | 399/237 |
| 2002/0064403 | A1 * | 5/2002 | Sakai et al. | 399/309 |
| 2002/0197087 | A1 * | 12/2002 | Caruthers et al. | 399/296 |

FOREIGN PATENT DOCUMENTS

| | | |
|---|---|---|
| JP | 55-33160 | 3/1980 |
| JP | 10-264594 | 10/1998 |
| JP | 11-223998 | 8/1999 |
| KR | 2001-84223 | 9/2001 |
| KR | 2002-25014 | 4/2002 |

* cited by examiner

*Primary Examiner*—Hoan Tran
(74) *Attorney, Agent, or Firm*—Staas & Halsey LLP

(57) ABSTRACT

A liquid electrophotographic image forming apparatus including a liquid carrier depositing unit that is arranged at a forward direction of the secondary transfer roller at a paper feed path and deposits liquid carrier on a print side of a sheet of paper that is secondarily transferred.

16 Claims, 2 Drawing Sheets

LIQUID ELECTROPHOTOGRAPHIC IMAGE FORMING APPARATUS HAVING A LIQUID CARRIER DEPOSITING UNIT

CROSS-REFERENCE TO RELATED APPLICATIONS

This application claims the priority of Korean Patent Application No. 2003-35600, filed on Jun. 3, 2003, in the Korean Intellectual Property Office, the disclosure of which is incorporated herein by reference.

BACKGROUND OF THE INVENTION

1. Field of the Invention

The present invention relates to a liquid electrophotographic image forming apparatus, and more particularly, to a liquid electrophotographic image forming apparatus having a unit for depositing a predetermined amount of a liquid carrier on a sheet of paper before an image is transferred onto the sheet of paper.

2. Description of the Related Art

Typically, a liquid electrophotographic printer forms an electrostatic latent image on a photosensitive medium, such as a photosensitive belt or a photosensitive drum, develops the electrostatic latent image with a developing agent having a predetermined color, and transfers the developed electrostatic latent image onto a recording sheet, thereby obtaining a desired image. The electrophotographic printer is largely categorized into liquid and dry electrophotographic printers depending on the type of developing agent. The liquid electrophotographic printer uses a liquid developing agent, which is a mixture of a powder toner and a volatile liquid carrier.

Since the liquid electrophotographic printer using a liquid developing agent uses toner having a fine particle size of approximately 0.5–5 μm, the liquid electrophotographic printer obtains a high-quality image compared to the dry electrophotographic printer using a powder toner when an electrostatic latent image is developed, and harmfulness caused by toner dust is prevented.

FIG. 1 shows a conventional liquid color image forming apparatus disclosed in U.S. Patent Publication Application No. 2003/0044202. Referring to FIG. 1, a plurality of image forming units are arranged in a series on a circulation path of a transfer belt 40 which travels in a closed endless loop by a plurality of rollers 41, 42, and 44. Each image forming unit transfers one of four color images, such as a yellow (Y) image, a cyan (C) image, a magenta (M) image, and a black (K) image, onto the transfer belt 40.

Each image forming unit includes a photosensitive drum 30 which transfers a toner image having a predetermined color onto the transfer belt 40, a charging roller 36 which charges the surface of the photosensitive drum 30 to a predetermined potential, a laser scanning unit (LSU) 38 which forms an electrostatic latent image by radiating light onto the surface of the photosensitive drum 30, and a developing unit which develops the electrostatic latent image to a predetermined toner image. An eraser 34 erases charge on the photosensitive drum 30.

The transfer belt 40 is supported by a driving roller 41, a secondary transfer backup roller 44, and a plurality of primary transfer backup rollers 42 which correspond to the photosensitive drum 30, and rotate, and an image formed on the photosensitive drum 30 is transferred onto the transfer belt 40. A secondary transfer roller 43 faces the secondary transfer backup roller 44 having the transfer belt 40 placed therebetween. The secondary transfer roller 43 transfers the image on the transfer belt 40 onto a sheet of paper 60.

A sheet of paper onto which a color image is transferred by the secondary transfer roller 43, is heated at a predetermined temperature and pressed by a fusing unit 50, which is installed on a paper exhaust path so that the toner image is fused on the sheet of paper 60.

The developing unit includes a developing container 14 in which a developing agent is stored, a developing roller 15, a part of which being soaked in the developing container 14 to face the photosensitive drum 30, a deposit roller 16, a cleaning roller 17, and a metering roller 18.

The developing roller 15 is partly soaked with the developing agent stored in the developing container 14. The deposit roller 16 is installed and soaked with the developing agent stored in the developing container 14. A predetermined voltage is applied to the deposit roller 16 when the deposit roller 16 is spaced a predetermined gap from the developing roller 15. The deposit roller 16 attaches the developing agent to the surface of the developing roller 15 using a potential difference between the deposit roller 16 and the developing roller 15 having a predetermined voltage.

The metering roller 18 is installed adjacent to the developing roller 15 and regulates the developing agent attached to the developing roller 15 by a predetermined thickness.

A cartridge 19 accommodates toner having a predetermined color with a high concentration to be supplied to the developing container 14.

Meanwhile, the developing agent stored in the developing container 14 is mixed with a norpar carrier so that a solid concentration of toner is approximately 5–20 percent by weight. A toner layer having a solid concentration of approximately 25–30 percent by weight is formed on the developing roller 15 by mass/area (M/A) 100–300 $\mu g/cm^2$. The toner layer develops the photosensitive drum 30, and a toner image is developed on the photosensitive drum 30, a color yellow image is transferred onto the transfer belt 40.

By performing development and transfer operations in the order of the image forming units, each color image is superimposed on and transferred onto the transfer belt 40 so that one color image is formed on the transfer belt 40. The transfer belt 40 is formed of a semiconductive material and does not absorb the carrier.

Subsequently, the color image on the transfer belt 40 is transferred onto a sheet of paper 60 that is fed between the secondary transfer roller 44 and the secondary transfer backup roller 43. Thus, when toner has a positive charge, an electrostatic force is applied to the toner so that a negative voltage is applied to the secondary transfer roller 44 and the color image on the transfer belt 40 is transferred onto the sheet of paper 60.

The amount of charge of dry toner is approximately 50 μC/g, whereas the charge amount of liquid toner is 2–10 times larger than the charge amount of the dry toner. Thus, when the liquid toner having a charge amount larger than the dry toner is transferred onto a sheet of paper, a high electrostatic force is applied to the sheet of paper. However, when a dielectric constant of the sheet of paper is low, transfer efficiency is reduced. In addition, because the dielectric constant of the sheet of paper varies according to the type of paper, printing quality also varies.

SUMMARY OF THE INVENTION

The present invention provides a liquid electrophotographic image forming apparatus having a unit for depositing a developing carrier on the surface of a sheet of paper so that a dielectric constant of the sheet of paper is increased to a predetermined level regardless of the dielectric constant of the sheet of paper and secondary transfer efficiency is improved.

According to an aspect of the invention, there is provided a liquid electrophotographic image forming apparatus having a transfer medium, a photosensitive medium that transfers a toner image onto the transfer medium, a charger which charges the photosensitive medium to a predetermined potential, a laser scanning unit which forms an electrostatic latent image by radiating light onto the surface of a charged photosensitive medium, a developing unit which develops the electrostatic latent image with toner, and a secondary transfer roller which transfers the toner image transferred onto the transfer medium onto a sheet of paper, wherein the apparatus includes a liquid carrier depositing unit which is arranged at a forward direction of the secondary transfer roller at a paper feed path and deposits a predetermined amount of a liquid carrier on the sheet of paper.

According to an aspect of the invention, the liquid carrier depositing unit includes a depositing roller that deposits the liquid carrier on the sheet of paper, and a pressing roller that supports the sheet of paper that passes between the pressing roller and the depositing roller.

The depositing roller may include an internal roller which absorbs the liquid carrier, and a porous film that surrounds an outer circumference of the internal roller.

The internal roller may be formed of a sponge in which a predetermined size of pores are formed. The pressing roller may be a rubber roller.

According to another aspect of the invention, the liquid carrier depositing unit further includes a brush that contacts at least one side of the sheet of paper and deposits the liquid carrier on the sheet of paper.

In addition, the liquid carrier depositing unit further includes upper and lower plates that form a path through which the sheet of paper passes, and the brush contacts the sheet of paper through a slit formed in the upper or lower plate. The slit is formed perpendicular to a direction in which the sheet of paper is transferred.

In addition, the liquid carrier depositing unit may further include a container in which the liquid carrier to be supplied to the brush is stored.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the aspects taken in conjunction with the accompanying drawings in which.

DETAILED DESCRIPTION OF THE PREFERRED EMBODIMENTS

Figure 1:
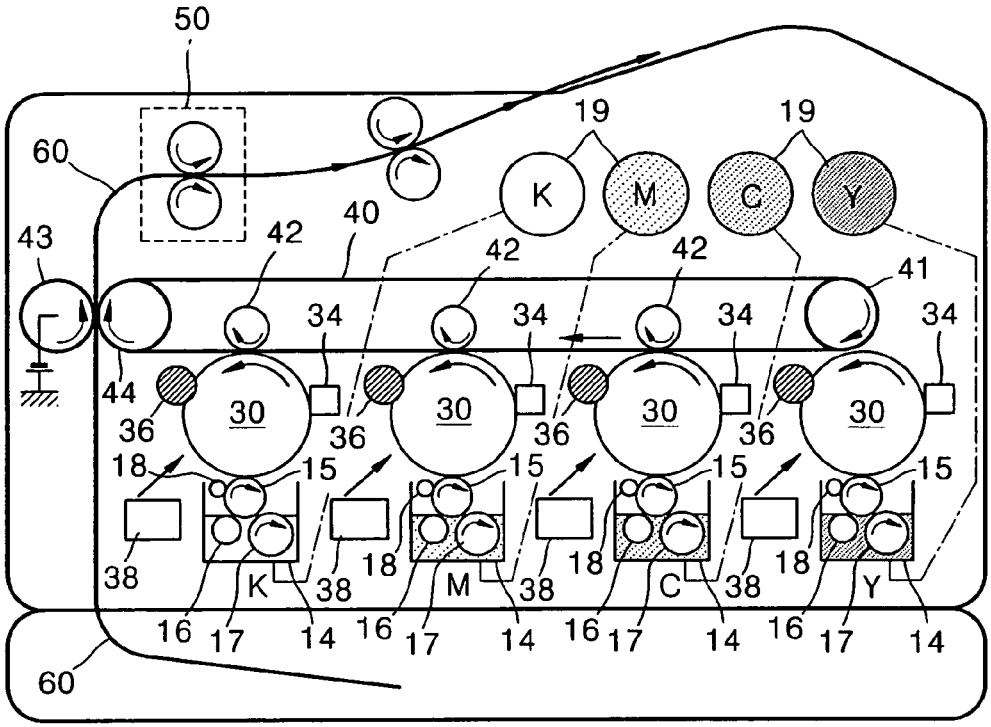
FIG. 1(PRIOR ART)
FIG. 1 shows a configuration of a conventional liquid color image forming apparatus.

Reference will now be made in detail to the embodiments of the present invention, examples of which are illustrated in the accompanying drawings, wherein like reference numerals refer to the like elements throughout. The embodiments are described below to explain the present invention by referring to the figures. Thickness of layers or regions are exaggerated for clarity.

Figure 2:
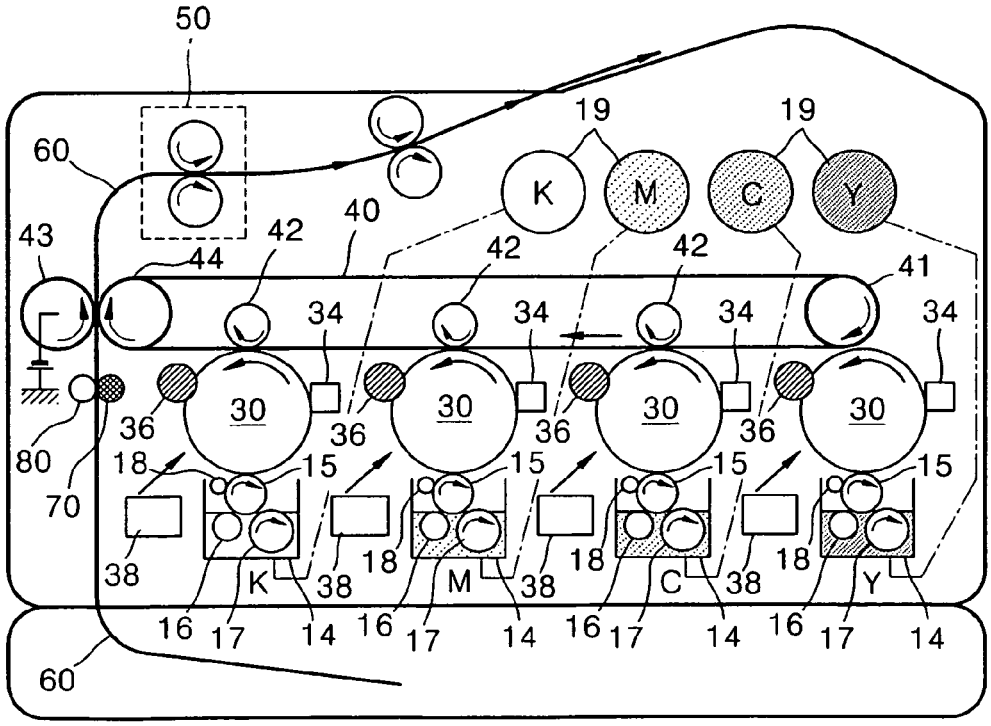
FIG. 2 shows a configuration of a liquid color image forming apparatus according to an embodiment of the invention.
Figure 3:
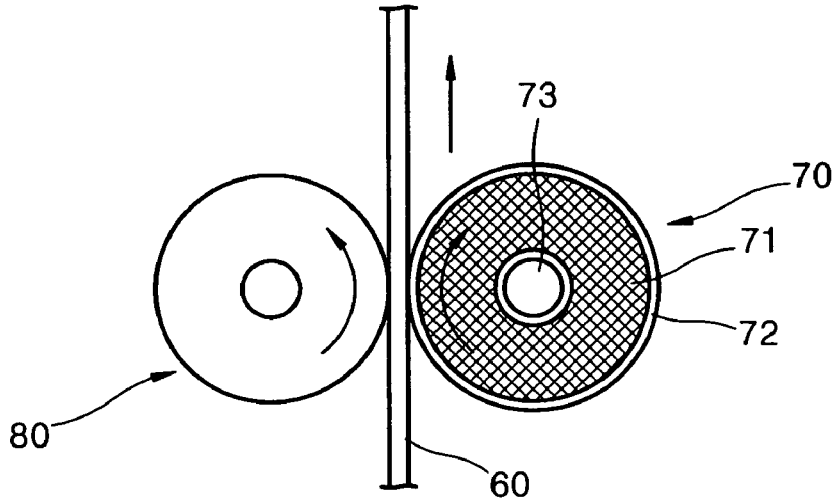
FIG. 3 shows a structure of a liquid carrier depositing unit according to a first embodiment of the invention.

FIG. 2 shows a configuration of a liquid color image forming apparatus according to an aspect of the invention. FIG. 3 shows a structure of a liquid carrier depositing unit according to a first aspect of the invention.

Referring to FIG. 2, a color image on a transfer belt 40 on which a yellow (Y) image, a cyan (C) image, a magenta (M) image, and a black (K) image are superimposed and transferred by image forming units arranged in a series at one side of the transfer belt 40, is secondarily transferred onto a sheet of paper 60 by a secondary transfer roller 43.

A transfer side of the sheet of paper 60 is deposited with a liquid carrier by a liquid carrier depositing unit arranged at a forward direction of the secondary transfer roller 43 on a paper feed path. The liquid carrier may be either NORPAR or ISOPAR hydrocarbon. By way of example, in FIG. 2, NORPAR is used as the liquid carrier.

Referring to FIG. 3, the liquid carrier depositing unit includes a carrier depositing roller 70 which deposits liquid carrier on a printing side of the sheet of paper 60, and a carrier pressing roller 80 which is rotated to be engaged with the carrier depositing roller 70 and pushes the sheet of paper 60 toward the carrier depositing roller 70.

The carrier depositing roller 70 includes an internal roller 71 formed of a sponge supported by a rotational shaft 73, and a porous film 72 which surrounds an outer circumference of the internal roller 71. The rotational shaft 73 is rotated by a motor (not shown) in a direction of a printing path.

Many pores are formed in the internal roller 71 so that a liquid carrier supplied from an external source is stored in the pores.

The porous film 72 is a film having fine pores. A polyester film having a thickness of 5–50 μm may be used as the porous film 72, and the size of each pore may be less than 0.2 μm.

The carrier pressing roller 80 is driven and rotated by the carrier depositing roller 70, the internal roller 71 is pressed, and the liquid carrier is smeared into pores of the porous film 72 so that the surface of the sheet of paper 60 is deposited with the liquid carrier. A rubber roller, for example, a silicon roller may be used as the carrier pressing roller 80.

The operation of the liquid electrophotographic image forming apparatus having the above structure according to the present invention will now be described in detail with reference to FIGS. 2 and 3.

First, a sheet of plain paper 60 having a dielectric constant of approximately 2.93 is supplied to a printing paper feed path. The sheet of paper 60 that is transferred on the printing paper feed path is deposited with the liquid carrier released from pores of the porous film 72 when a printing side is attaches to the carrier depositing roller 70 by a pressure from the carrier pressing roller 80. The dielectric constant of the sheet of paper 60 deposited with the liquid carrier is increased approximately 2–3 times.

The sheet of paper 60 that passed the carrier depositing roller 70 is fed between the secondary transfer roller 43 and the secondary transfer backup roller 44, and a color image on the transfer belt 40 is transferred onto the sheet of paper 60 by an electrostatic force of the secondary transfer roller 43 to which a voltage having a polarity different from the polarity of the toner is applied. In this case, due to an increase in the dielectric constant of the sheet of paper 60, a transfer operation is more easily performed, and transfer quality is improved.

The color image is fused and transferred to the sheet of paper 60 by the fusing unit 50.

The pressing roller 80 may be made of a rubber material or have the same structure as the structure of the depositing roller 70.

Figure 4:
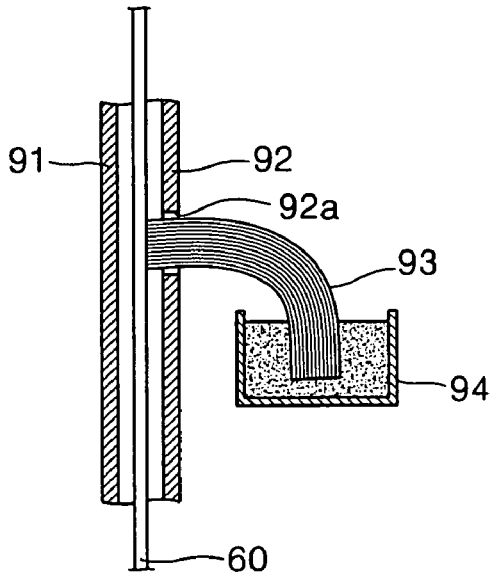
FIG. 4 shows a structure of a liquid carrier depositing unit according to a second embodiment of the invention.

FIG. 4 shows a structure of a liquid carrier depositing unit according to a second aspect of the invention.

Referring to FIG. 4, the sheet of paper 60 passes between a lower plate 91 and an upper plate 92 on a paper transfer path to the secondary transfer roller 43. A slit 92*a* is formed in the upper plate 92 to be approximately perpendicular to a direction in which the sheet of paper 60 is transferred. A brush 93 is located in the slit 92*a* to contact the sheet of paper 60. Meanwhile, a liquid carrier container 94 is located at one side of the upper plate 92, and one end of the brush 93 is soaked in the liquid carrier in the liquid carrier container 94 so that the liquid carrier is transferred to the other end of the brush 93 and the sheet of paper 60 is deposited with the liquid carrier.

The operation of the liquid electrophotographic image forming apparatus according to the second aspect of the present invention is described below in detail with reference to FIGS. 2 and 4.

A sheet of plain paper 60 having a dielectric constant of approximately 2.93 is supplied to a printing paper feed path formed of the upper plate 92 and the lower plate 91. The sheet of paper 60 that is transferred on the printing paper feed path is supported by the lower plate 91 and is deposited with the liquid carrier by the brush 93 that is located in the slit 92*a*. The dielectric constant of the sheet of paper 60 deposited with the liquid carrier is increased approximately 2–3 times. Meanwhile, the liquid carrier, or solution, to be supplied on the sheet of paper 60 is supplied to the brush 93 from the liquid carrier container 94 by a capillary force.

The sheet of paper 60 that passed the brush 93 is fed between the secondary transfer roller 43 and the secondary transfer backup roller 44, and a color image on the transfer belt 40 is transferred onto the sheet of paper 60 by an electrostatic force of the secondary transfer roller 43 to which a voltage having a polarity different from the polarity of toner is applied. In this case, due to an increase in the dielectric constant of the sheet of paper 60, a transfer operation is easily performed, and transfer quality is improved.

The color image is fused and transferred to the sheet of paper 60 by the fusing unit 50.

As described above, in the liquid electrophotographic image forming apparatus according to the present invention, regardless of the type of paper used as a secondary transfer medium, the sheet of paper is deposited with a liquid carrier to have a predetermined dielectric constant and is secondarily transferred such that good printing quality is obtained.

Although a few aspects of the present invention have been shown and described, it would be appreciated by those skilled in the art that changes may be made in this aspect without departing from the principles and spirit of the invention, the scope of which is defined in the claims and their equivalents.

What is claimed is:

1. A liquid electrophotographic image forming apparatus including a transfer medium, a photosensitive medium that transfers a toner image onto the transfer medium, a charger that charges the photosensitive medium to a predetermined potential, a laser scanning unit that forms an electrostatic latent image by radiating light onto the surface of a charged photosensitive medium, a developing unit that develops the electrostatic latent image with toner, and a secondary transfer roller that transfers the toner image transferred onto the transfer medium onto a sheet of paper, the apparatus comprising:

a liquid carrier depositing unit that is arranged at a forward direction of the secondary transfer roller at a paper feed path and deposits a predetermined amount of a liquid carrier on the sheet of paper, wherein the liquid carrier depositing unit comprises:

a depositing roller that deposits the liquid carrier on the sheet of paper, and a pressing roller that supports the sheet of paper that passes between the pressing roller and the depositing roller, wherein the depositing roller comprises:

an internal roller that absorbs the liquid carrier, and a porous film that surrounds the outer circumference of the internal roller.

2. The apparatus of claim 1, wherein the internal roller is a sponge-material having a plurality of predetermined pore sizes formed thereon.

3. The apparatus of claim 1, wherein the pressing roller is a rubber roller.

4. A liquid electrophotographic image forming apparatus including a transfer medium, a photosensitive medium that transfers a toner image onto the transfer medium, a charger that charges the photosensitive medium to a predetermined potential, a laser scanning unit that forms an electrostatic latent image by radiating light onto the surface of a charged photosensitive medium, a developing unit that develops the electrostatic latent image with toner, and a secondary transfer roller that transfers the toner image transferred onto the transfer medium onto a sheet of paper, the apparatus comprising:

a liquid carrier depositing unit that is arranged at a forward direction of the secondary transfer roller at a paper feed path and deposits a predetermined amount of a liquid carrier on the sheet of paper, wherein the liquid carrier depositing unit further comprises a brush that contacts at least one side of the sheet of paper and deposits the liquid carrier on the sheet of paper.

5. The apparatus of claim 4, wherein the liquid carrier depositing unit further comprises upper and lower plates that form a path through which the sheet of paper passes, and the brush contacts the sheet of paper through a slit formed in at least one of the upper or lower plate.

6. The apparatus of claim 5, wherein the slit is approximately perpendicular to a direction in that the sheet of paper is transferred.

7. The apparatus of claim 4, wherein the liquid carrier depositing unit further comprises a container to store the liquid carrier that is supplied to the brush.

8. A liquid electrophotographic image forming apparatus comprising a unit depositing an amount of a liquid carrier on a print medium before an image is transferred onto the print medium in order for the print medium to have a predetermined dielectric constant regardless of the dielectric constant of the print medium, wherein the unit depositing the liquid carrier on the print medium comprises:

a first roller depositing the liquid carrier on a print side of the print medium, and a second roller pushing the print medium towards the first roller, wherein the first and second rollers guide the print medium in a direction towards to transfer an image onto the print medium, wherein the first roller comprises:

an interior roller formed of a sponge-like material supported by a rotational shaft, and a porous film surrounding the outer circumference of the interior roller, wherein the internal roller releases the liquid carrier into pores of the porous film when the internal roller is pressed by the second roller bushing the print medium towards the first roller.

9. The apparatus of claim 8, wherein the porous film is a polyester film having a thickness of approximately 5–50 μm and the size of each pore is less than approximately 0.2 μm.

10. The apparatus of claim 8, wherein the second roller is comprised of a rubber material.

11. The apparatus of claim 8, wherein the second roller comprises the same structure as the structure of the first roller.

12. The apparatus of claim 8, wherein the rotational shaft is rotated by a motor in the direction towards the transfer roller to transfer the image onto the print medium.

13. A liquid electrophotographic image forming apparatus comprising a unit depositing an amount of a liquid carrier on a print medium before an image is transferred onto the print medium in order for the print medium to have a predetermined dielectric constant regardless of the dielectric constant of the print medium, wherein the unit depositing the liquid carrier on the print medium comprises:

a first plate having a slit formed perpendicular to a direction in which the print medium is transferred, and a second plate located parallel to the first plate, wherein the first and second plates are located on opposite sides of the transfer belt and the print medium passes between the first and second plates towards the transfer roller to transfer the image onto the print medium.

14. The apparatus of claim 13, further comprising an instrument located in the slit of the first plate, wherein a first end of the instrument contacts the print medium and a second end of the instrument is located inside a container of liquid carrier and transfers the liquid carrier to the first end of the instrument to deposit the liquid carrier on the print medium.

15. The apparatus of claim 14, wherein the liquid carrier is transferred to the first end of the instrument by a capillary force.

16. The apparatus of claim 15, wherein the instrument located in the slit is a brush.

* * * * *

UNITED STATES PATENT AND TRADEMARK OFFICE

CERTIFICATE OF CORRECTION

PATENT NO. : 7,092,661 B2
APPLICATION NO. : 10/849180
DATED : August 15, 2006
INVENTOR(S) : In-yong Song It is certified that error appears in the above-identified patent and that said Letters Patent is hereby corrected as shown below:

Col. 7, line 10, change “bushing” to --pushing--

Signed and Sealed this

Thirteenth Day of February, 2007

JON W. DUDAS
*Director of the United States Patent and Trademark Office*